United States Patent [19]

Naimer et al.

[11] Patent Number: 4,573,029

[45] Date of Patent: Feb. 25, 1986

[54] SWITCH DEVICE

[76] Inventors: Hubert L. Naimer, Nuvola Bianca, Ascona, Switzerland, CH-6612; Gottfried Alsch, Genarogasse 5, Vienna, Austria, A-1232

[21] Appl. No.: 598,782

[22] Filed: Apr. 10, 1984

[30] Foreign Application Priority Data

Apr. 25, 1983 [AT] Austria ..... 1496/83

[51] Int. Cl.[4] ..... H01H 67/06

[52] U.S. Cl. ..... 335/122; 335/140; 200/153 P

[58] Field of Search ..... 335/121, 122, 131, 140; 200/153 P, 153; 74/110

[56] References Cited

U.S. PATENT DOCUMENTS 2,047,061 7/1936 Edwards ..... 74/110

2,432,782 12/1947 McClain ..... 335/131

*Primary Examiner*—George Harris

*Attorney, Agent, or Firm*—Kurt Kelman

[57] ABSTRACT

A switch comprises switch members movable in an operating direction for opening and closing an electric circuit, a solenoid drive for moving the switch members in the operating direction, the solenoid drive comprising an armature having an operating movement normal to the operating direction of the switch members and a core, a push rod whereto the switch members are coupled for movement therewith, the push rod comprising a gear rack, and a pinion segment meshing with the gear rack. The push rod and the pinion segment are located between the armature and the core and are surrounded thereby, the pinion segment is pivotal about an axis extending transversely to the push rod and is engaged by the armature, the operating movement of the armature pivoting the pinion segment and moving the push rod and switch members coupled thereto in the operating direction.

3 Claims, 4 Drawing Figures

SWITCH DEVICE

Figure 1:
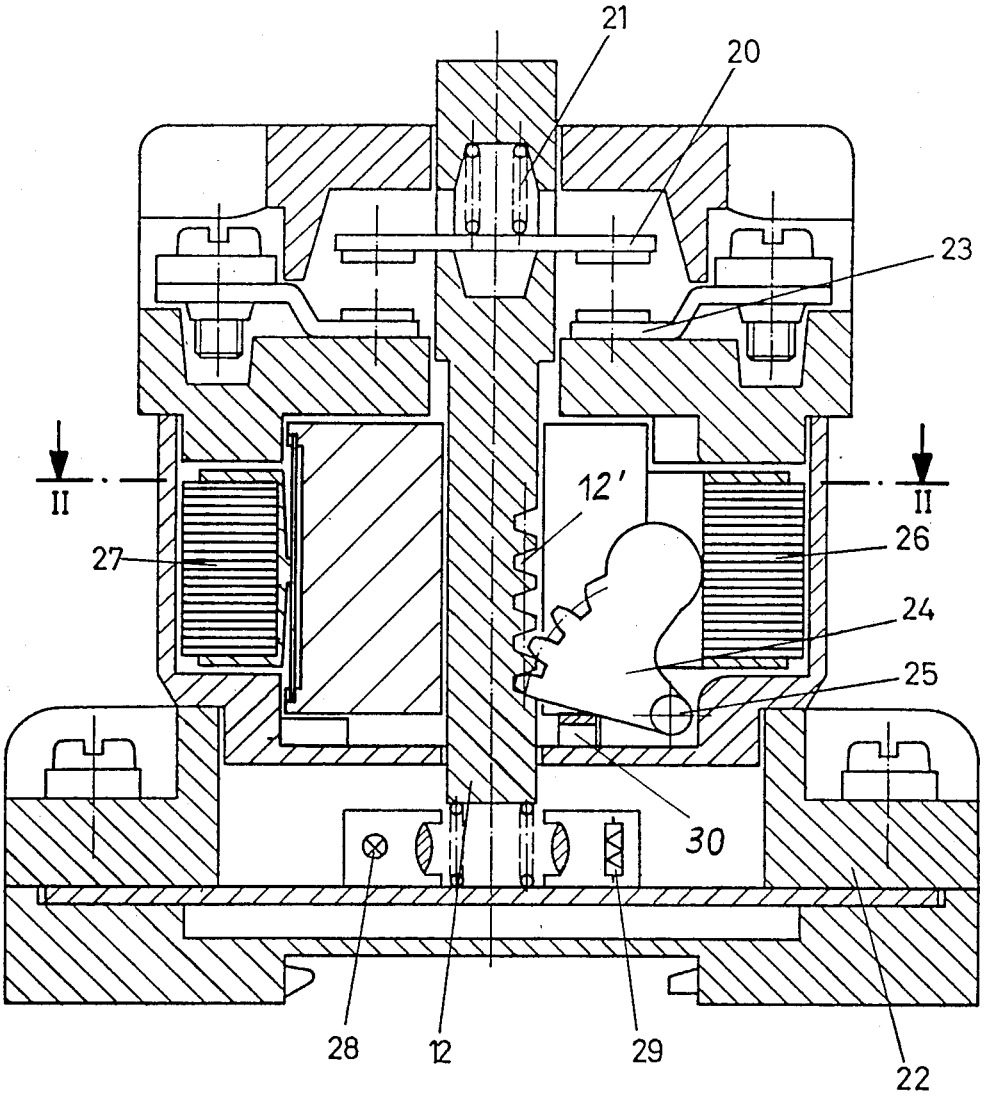

The invention relates to a switch device, in particular for electrical circuits, having a solenoid drive means which is connected to movable switch members and has an operating movement which is substantially normal to the direction of movement of the switch members, and acts on the switch members by way of a transmission member.

Switch devices of that kind are disclosed for example in Swiss Pat. No. 349 324, wherein two armature members which are movable relative to each other act as transmission members, by way of respective lever arms which are connected to the armature members and to a push rod which actuates the switch members. That arrangement suffers from the disadvantage of a very unfavourable relationship in respect of the distances covered by the push rod and the armature members close to the fully attracted position of the armature members. In addition, that arrangement has a relatively large operating air gap for the magnet system.

The aim of the present invention is to avoid those disadvantages and to provide a switch device which is distinguished by a simple and compact construction and wherein it is possible to provide an operating air gap in the magnet system, which corresponds to the contact travel.

In accordance with the invention, the switch members are coupled to a push rod of which at least a portion is formed as a gear rack and the solenoid surrounds the push rod. Transmission of the movement of the solenoid armature to the push rod is effected by way of a pinion segment which is pivotal about an axis extending transversely to the push rod and which meshes with the portion of the push rod that is formed as the gear rack.

That arrangement therefore uses only a single transmission member, while only one mounting means is required. The assembly cost in production of the switch device is, therefore, very low. In addition, that arrangement also gives a very compact construction as the pinion segment is disposed in the interior of the magnet system.

Another feature of the invention provides that the pinion segment and the armature of the solenoid engage each other with a small clearance by means of raised portions and recessed portions, which extend parallel to the pivot axis of the pinion segment, the generated surfaces of the raised portions being of a convexly curved configuration in a cross-sectional plane which extends normal to the pivot axis. By virtue of that positive coupling of the armature of the magenet system to the contacts by way of the pinion segment and the push rod, a portion of which is in the form of a gear rack, the armature may be used as an indication in respect of the position of the contacts, in any position of installation of the switch device. Thus, the armature may be provided with a projection portion which extends through an opening in the housing and the position of which then provides a clear indication of the position of the contacts. In that way it is easily possible, for example even from the outside, to establish whether the contacts are welded together or whether the armature has not been attracted, in spite of a voltage being applied to the coil of the switch device.

In order to ensure advantageous frictional conditions in regard to mutual engagement of the pinion segment and the armature, it is advantageous for the raised portion to be of a tooth-like configuration in cross-section, thereby providing that the members which are engaged with each other roll against each other in a highly advantageous manner.

Figure 2:
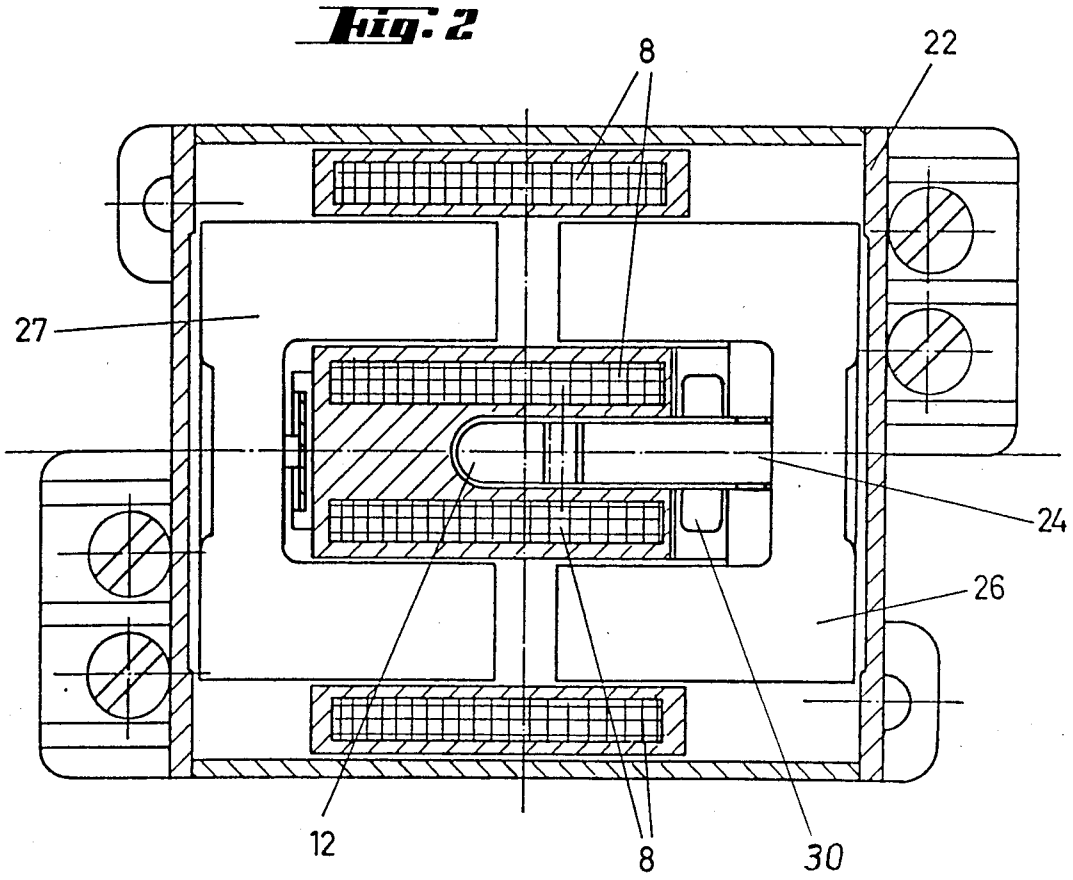
Figure 3:
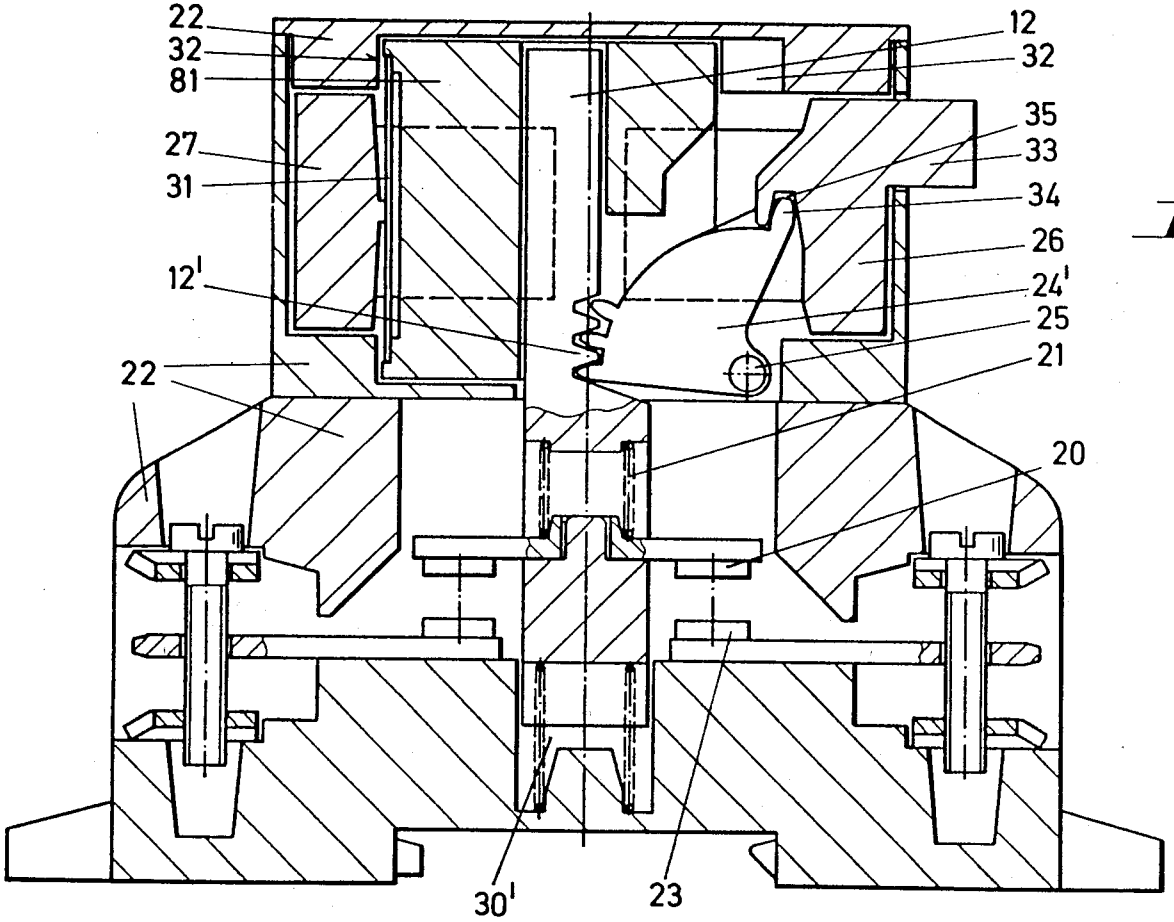
Figure 4:
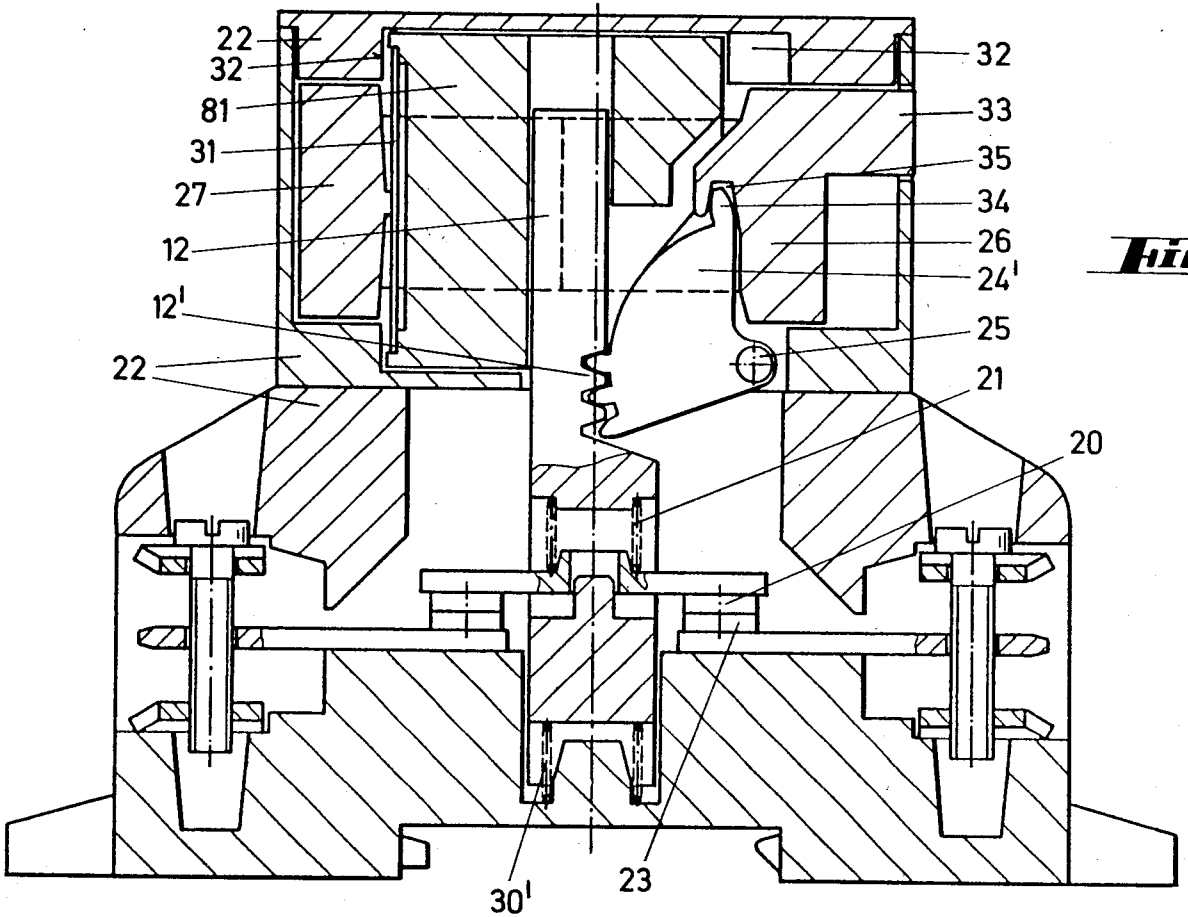

The invention will now be described in greater detail with reference to the drawings in which:

FIGS. 1 and 2 show a switch device according to the invention, in two sections which are perpendicular to each other, and FIGS. 3 and 4 show views in vertical section through another embodiment of a switch device according to the invention, in two different switching positions.

In the embodiment illustrated in FIGS. 1 and 2, the movable contacts 20 are coupled by way of the contact springs 21 and to a push rod 12 of which a portion is formed as a gear rack 12' and which is axially displaceably mounted in the housing 22 in which the contacts 23 together with the terminals are also mounted. Also disposed in the housing 22, as shown in diagrammatic form in FIG. 1, is a photo detector which is essentially formed by a light emitting diode 28 and a photo resistor 29. The push rod 12 moves into the beam of the photo detector when the contacts 20 and 23 are in the closed condition, thereby controlling a position indicator for monitoring the position of the contacts 20. However, the position indicator is not a part of the invention and may also be omitted.

A pinion segment 24 meshes with the portion of the push rod 12 which is formed as the gear rack 12'. The pinion segment 24 is pivotal about an axis 25 that is disposed in the housing 22 and extends transversely with respect to the push rod 12. The pinion segment 24 is urged against the U-shaped armature 26 by means of a spring 30. The armature 26 co-operates with a core 27 which is also of U-shaped configuration and the two limb portions of core 27 and armature 26 engage two coils 8. The core is fixedly mounted in the housing 22.

When the coils 8 are energised, the armature 26 is attracted and the movement of the armature applies a force to the pinion segment 24 which is rotated thereby. In the course of that rotary movement, the push rod 12, the portion of which that is formed as the gear rack 12' meshes with the pinion segment, is moved downwardly and the contacts 20, 23 close. When that happens, the spring is depressed.

When the voltage is removed from the coils 8, the spring 30 urges the pinion segment 24 back into the starting position, whereby the armature returns to its outward position and the push rod is displaced upwardly and the contacts 20, 23 are opened thereby.

In the embodiment illustrated in FIGS. 3 and 4, the contacts 20, 23 together with the associated terminals are disposed below the magnet system. In addition, in this embodiment, the core 27 is supported of a plate or leaf spring 31 against a coil body 81 in which the coils 8 (not visible in FIGS. 3 and 4) are embedded and which is fixed in position by projections 32 on the housing 22. In addition, instead of the spring 30 which is provided in the embodiment illustrated in FIGS. 1 and 2, to act on the pinion segment 24, this embodiment has a spring 30' which engages the push rod 12 at the end thereof.

An important difference in comparison with the embodiment illustrated in FIGS. 1 and 2 is that the embodiment of FIGS. 3 and 4 provides for direct coupling of the contacts 20 to the armature 26 which is provided with an indicator lug 33 which is integrally formed on the armature 26 which, like the core 27, comprises a laminated metal plate pack with plastics material injection moulded therearound. The coupling action is produced by a raised portion 34 which is formed on the pinion segment 24' and which engages a groove 35 in the armature 26. The raised portion 34 is of a tooth-like configuration, in a cross-sectional plane which is normal to the pivot axis 25 of the pinion segment 24, to permit an easy rolling movement of the projection against the walls of the groove 35.

As can be seen from FIGS. 1 to 4, the surface of the pinion segment 24, 24' which bears against the armature or which is pressed thereagainst by virtue of the force of the springs 30 and 30', and the pinion segment tooth flank which leads in the direction of the closing movement of the contacts, are disposed at an angle of about 90°, thereby transmitting the movement of the armature to the push rod 12 in a ratio of about 1:1.

We claim:

1. A switch device for opening and closing an electrical circuit, which comprises (a) switch members movable in an operating direction for opening and closing the circuit, (b) solenoid drive means for moving the switch members in the operating direction, the solenoid drive means comprising (1) an armature having an operating movement which is substantially normal to the operating direction of the switch members and (2) a core, (c) a push rod whereto the switch members are coupled for movement therewith, the push rod comprising (1) a gear rack, and (d) a pinion segment meshing with the gear rack, the push rod and the pinion segment being located between said armature and said core and being surrounded thereby, the pinion segment being pivotal about an axis extending transversely to the push rod and being engaged by the armature, the operating movement of the armature pivoting the pinion segment and moving the push rod and switch members coupled thereto in the operating direction.

2. The switch device of claim 1, wherein the pinion segment has a raised portion and the armature has a recessed portion, the pinion segment and armature portions being in engagement with each other with a small clearance, the recessed portion extending parallel to the pivot axis of the pinion segment and the raised portion having generated surfaces extending parallel to the pivot axis of the pinion segment and being convexly curved in a plane extending normal to the pivot axis.

3. The switch device of claim 2, wherein the raised portion is of tooth-like configuration in cross section.

* * * * *